US007134296B2

(12) United States Patent
Howard

(10) Patent No.: US 7,134,296 B2
(45) Date of Patent: Nov. 14, 2006

(54) METHOD FOR PROVIDING COOLING FOR GAS LIQUEFACTION

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 268 days.

(21) Appl. No.: 10/962,667

(22) Filed: Oct. 13, 2004

(65) Prior Publication Data

US 2006/0075776 A1 Apr. 13, 2006

(51) Int. Cl.
*F25J 1/00* (2006.01)

(52) U.S. Cl. ..... 62/613; 62/611

(58) Field of Classification Search ..... 62/611, 62/612, 613

See application file for complete search history.

(56) References Cited

U.S. PATENT DOCUMENTS

| | | | | |
|---|---|---|---|---|
| 2,814,936 | A | 12/1957 | Morrison | 62/175.5 |
| 3,360,944 | A | 1/1968 | Knapp et al. | 62/12 |
| 5,231,835 | A | 8/1993 | Beddome et al. | 62/9 |
| 5,636,529 | A * | 6/1997 | Schmidt | 62/613 |
| 6,065,305 | A * | 5/2000 | Arman et al. | 62/613 |
| 6,196,021 | B1 | 3/2001 | Wissolik | 62/606 |
| 6,220,053 | B1 * | 4/2001 | Hass et al. | 62/613 |
| 6,694,774 | B1 | 2/2004 | Rashad et al. | 62/612 |

* cited by examiner

*Primary Examiner*—William C. Doerrler
(74) *Attorney, Agent, or Firm*—Donald T. Black

(57) ABSTRACT

A method for generating refrigeration for cooling a product gas wherein a first or working gas undergoes a staged expansion to a first temperature and a subsequent turboexpansion to a second higher temperature and both the expanded gas and the turboexpanded gas provide cooling to the product gas.

6 Claims, 1 Drawing Sheet

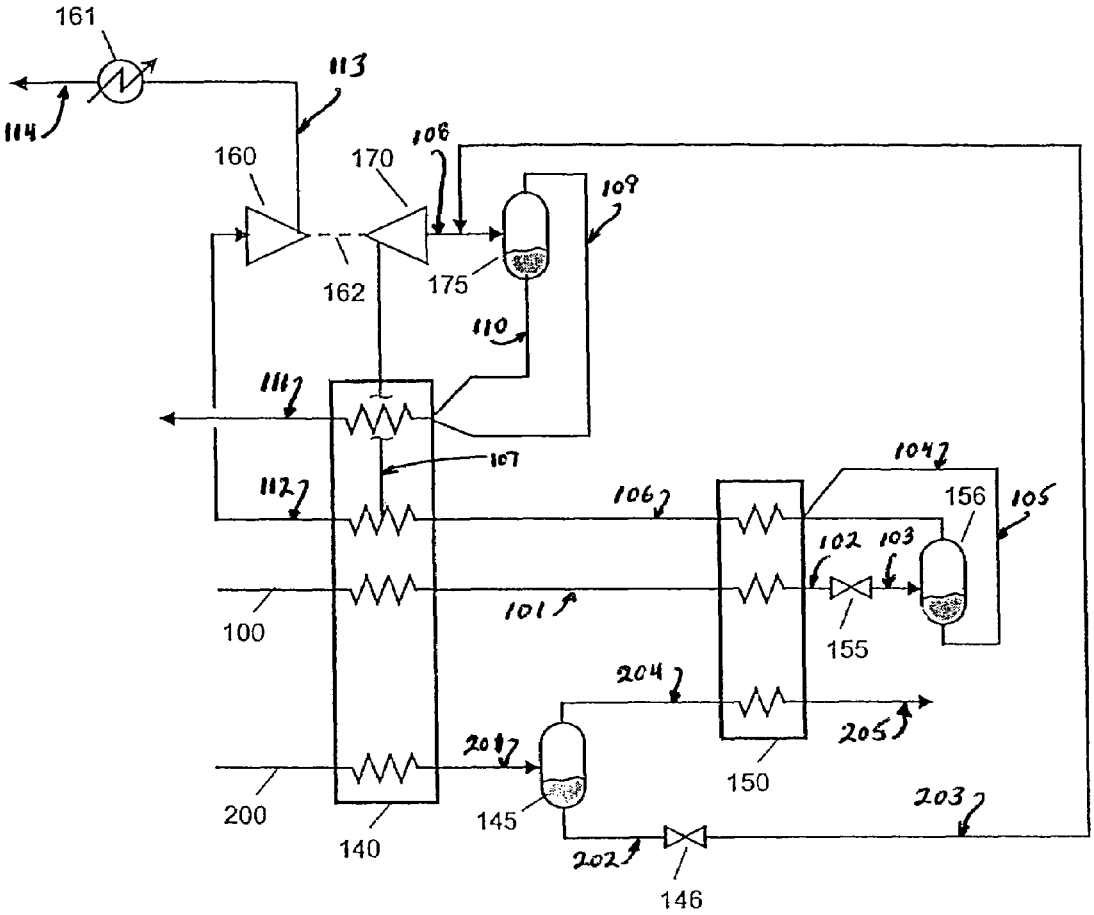
161
113
114
160
170
106
109
162
175
110
111
107
112
106
104
156
105
102
103
100
101
155
204
205
201
150
200
145
203
140
202
146

METHOD FOR PROVIDING COOLING FOR GAS LIQUEFACTION

TECHNICAL FIELD

This invention relates generally to providing cooling to a gas for the liquefaction of that gas, and is particularly applicable for providing cooling to natural gas for the subsequent production of liquefied natural gas.

BACKGROUND ART

The generation of refrigeration for the cooling of gas for subsequent liquefaction is costly and energy intensive. In some situations, such as the passage of natural gas in a transmission line, pressure energy is available for the generation of refrigeration for the cooling of the gas. It is desirable to have an efficient method for utilizing pressure energy to generate refrigeration for cooling a gas stream for subsequent liquefaction.

Accordingly, it is an object of this invention to provide an improved method for utilizing pressure energy to generate refrigeration for cooling a gas stream for subsequent liquefaction.

SUMMARY OF THE INVENTION

The above and other objects, which will become apparent to those skilled in the art upon a reading of this disclosure, are attained by the present invention which is:

A method for cooling a gas for liquefaction comprising:

(A) cooling a working gas and expanding the cooled working gas to provide an expanded gas at a first temperature;

(B) warming the expanded gas to provide cooling to a product gas;

(C) turboexpanding at least a portion of the warmed expanded gas to provide a turboexpanded gas at a second temperature which is greater than the first temperature; and (D) warming the turboexpanded gas to provide cooling to the working gas and to the product gas.

As used herein the term "Joule-Thomson expansion" means expansion employing an isenthalpic pressure reduction device which typically may be a throttle valve, orifice or capillary tube.

As used herein the term "turboexpansion" means an expansion employing an expansion device which produces shaft work. Such shaft work is produced by the rotation of a shaft induced by the depressurization of a fluid through one or more fluid conduits connected to the shaft, such as a turbine wheel.

As used herein the term "indirect heat exchange" means the bringing of two fluids into heat exchange relation without any mixing of the fluids with each other.

BRIEF DESCRIPTION OF THE DRAWING

The sole FIGURE is a simplified schematic representation of one preferred embodiment of the gas cooling method of this invention.

DETAILED DESCRIPTION

In general, this invention is directed to a method for generating refrigeration for cooling gas wherein the refrigeration is generated by a defined sequential expansion and subsequent turboexpansion of a working gas. By use of the defined staged expansion, the refrigerating effect of the pressure reduction is distributed over a wider temperature range than with conventional practice, resulting in improved cooling efficiency. Preferably the working gas for staged expansion and the gas to be cooled have the same composition. Most preferably both the working gas for staged expansion and the gas to be cooled comprise natural gas.

The invention will be described in greater detail with reference to the Drawing. Referring now to the FIGURE, first or working gas stream 100, which preferably comprises natural gas, is cooled by passage through heat exchanger 140 by indirect heat exchange with turboexpanded gas as will be more fully described below. Typically working gas stream 100 is at a pressure within the range of from 700 to 1500 pounds per square inch absolute (psia). The cooled gas stream 101 is then further cooled by passage through heat exchanger 150 by indirect heat exchange with expanded gas, as will be more fully described below, to produce cooled working gas stream 102. The temperature of the cooled working gas stream is preferably below the critical temperature of the gas of this gas stream, or below the critical temperature of the primary component of the gas when the gas is a mixture. For example, when the cooled working gas stream is natural gas, the temperature of the cooled gas stream 102 is preferably less than −116.5° F. which is the critical temperature of methane.

Cooled working gas stream 102 is expanded in a first expansion, such as by passing through Joule-Thomson valve 155, to produce an expanded gas stream 103 at a first temperature, which, in the case where the working gas stream comprises natural gas, is typically within the range of from −120 to −200° F. The first expansion may be with or without the production of shaft work. In the embodiment of the invention illustrated in the FIGURE, the first expansion is a Joule-Thomson expansion which results in a two-phase stream 103 which is passed to phase separator 156 wherein it is separated for purposes of distribution, in vapor stream 104 and liquid stream 105, into a common pass of heat exchanger 150 and subsequently in heat exchanger 140. Alternatively streams 104 and 105 may be warmed in separate passages of each of heat exchangers 150 and 140. Although illustrated as separate elements in the FIGURE, those skilled in the art will recognize that heat exchangers 150 and 140 may be combined into a single core.

The expanded gas stream is warmed by passage through heat exchanger 150 to provide cooling to product gas, as will be more fully described below. Resulting expanded gas stream 106 is further warmed in heat exchanger 140 to provide cooling by indirect heat exchange to the product gas and also to the cooling gas stream 100.

A portion 107 of stream 106, typically from 30 to 60 percent of stream 106, is withdrawn after partial traverse of heat exchanger 140 and passed to turboexpander 170 wherein it is turboexpanded to provide turboexpanded gas stream 108 having a second temperature which exceeds the first temperature. Generally the temperature of turboexpanded gas stream 108 will be at least 30° F. greater than the temperature of expanded gas stream 103. When the working gas comprises natural gas, the temperature of turboexpanded gas stream 108 is typically within the range of from −30 to −100° F.

In the embodiment of the invention illustrated in the FIGURE, turboexpanded stream 108 is passed to phase separator 175 and the vapor and liquid fractions are passed in respective streams 109 and 110 to a common pass of heat exchanger 140. Within heat exchanger 140 the turboexpanded gas stream is warmed by indirect heat exchange to provide cooling to working gas stream 100 and also to the product gas stream. Resulting warmed turboexpanded gas stream 111 is withdrawn from heat exchanger 140 and may be recovered.

A portion 112 of expanded gas stream 106 which is not passed to the turboexpander, is passed to compressor 160, which is preferably powered by the shaft work of expansion derived from turboexpander 170 and illustrated in representational form 162. After compression, the gas in stream 113 may be cooled in heat exchanger 161 and recovered in stream 114.

Product gas in stream 200 is passed through heat exchanger 140 wherein it is cooled by indirect heat exchange with the warming Joule-Thomson expanded gas and also the warming turboxpanded gas. Product gas 200 may have the same composition as, or may have a different composition from, working gas 100. In a particularly preferred embodiment of this invention, both working gas 100 and product gas 200 comprise natural gas and are both taken from a high pressure natural gas transmission pipeline or gas well. Alternatively product gas 200 may be derived from another natural gas source or may be a different gas, e.g. nitrogen gas.

Resulting cooled product gas 201, which in the embodiment illustrated in the FIGURE is a two-phase stream, is passed to phase separator 145. A similar vessel to vessel 145 may be employed for hydrocarbon removal from steam 101 if feed constituents of stream 100 may freeze out at the temperature of stream 103. Liquid is withdrawn from phase separator 145 in stream 202, passed through valve 146 and, in the embodiment illustrated in the FIGURE, passed in stream 203 for combination with stream 108 and further processing as was described above. Vapor is withdrawn from phase separator 145 in stream 204 and further cooled by passage through heat exchanger 150 by indirect heat exchange with warming Joule-Thomson expanded first gas. The resulting cooled product gas stream 205 is then recovered, preferably after undergoing liquefaction. Product gas stream 205 may be depressurized into liquefied natural gas or may be refrigerated further.

Inlet temperature control on turbine 170 is important to operation. Such control may be affected by way of bypass lines configured around heat exchanger 140. As an example, expanded cold gas from the inlet of heat exchanger 140 can be joined with a side stream (as shown) to decrease the inlet temperature of turbine. Such an option may be important for controlling the temperature at which heavier hydrocarbons are separated from the liquefaction feed in vessel 145. A similarly important option for operation involves inlet temperature control on compressor 160. It is possible to bypass a portion of the colder side draw from exchanger 140 into the inlet of compressor 160. In so doing, the pressure increase across the compressor can be increased. This may facilitate subsequent combination of the compressor discharge with the inlet feed gas 100 or return back to the high-pressure source. An externally powered compressor may be employed for this purpose as well.

The FIGURE depicts the separation of high-boiling constituents from the cooling/liquefaction stream 200 via phase separator 145. The condensable compounds can be directed to the turbine exhaust as shown or may be taken as a separate product. Alternatively, the heavier hydrocarbons may be directed to several stages of partial condensation and/or distillation for the production of products. In the case of natural gas such products may include, LPG, propane or butane product streams. In addition, the liquid fraction obtained from vessel 175 may also be directed to such recovery means (rather than vaporization as shown). If necessary, a phase separator may be employed on the working gas stream and used to extract heavier hydrocarbons in a fashion comparable to that shown for the product gas stream. In some instances stream 100 may be available at a pressure such that two phases are not formed upon pressure reduction at valve 155. In this scenario, phase separation vessel 156 may be unnecessary.

In the FIGURE, streams 100 and 200 are shown as separate process streams. This feature illustrates the fact that such streams may be derived from different sources or in fact may be different gases. In some instances, the gases may be relatively pure components. In this situation, phase separation means 175 and 145 may be unnecessary and may be excluded from the process without loss of efficiency. In the case where streams 100 and 200 are derived from the same source (e.g. a high-pressure natural gas pipeline) a single integrated or staged process may be used for pretreatment purposes. As an example, a single feed stream may be fed to a dehydration system. The dehydration could be by physical means (cooling/condensation) and subsequent adsorption, such as temperature swing adsorption. The combined stream may then be split into streams 100 and 200. Liquefaction stream 200 may be treated for $CO_2$ removal in a separate process.

The invention claimed is:

1. A method for cooling a gas for liquefaction comprising:

(A) cooling a working gas and expanding the cooled working gas to provide an expanded gas at a first temperature;

(B) warming the expanded gas to provide cooling to a product gas;

(C) turboexpanding at least a portion of the warmed expanded gas to provide a turboexpanded gas at a second temperature which is greater than the first temperature; and (D) warming the turboexpanded gas to provide cooling to the working gas and to the product gas.

2. The method of claim 1 wherein the working gas comprises natural gas.

3. The method of claim 1 wherein the product gas comprises natural gas.

4. The method of claim 1 wherein the second temperature exceeds the first temperature by at least 30° F.

5. The method of claim 1 wherein the first temperature is within the range of from −120 to −200° F., and the second temperature is within the range of from −30 to −100° F.

6. The method of claim 1 wherein the cooled working gas is expanded in a Joule-Thomson expansion.

* * * * *